US011577304B2

(12) United States Patent
Han

(10) Patent No.: US 11,577,304 B2
(45) Date of Patent: Feb. 14, 2023

(54) PROCESS FOR MAKING AN EROSION AND WEAR RESISTANT SHOT CHAMBER FOR DIE CASTING APPLICATION

(71) Applicant: Qingyou Han, West Lafayette, IN (US)

(72) Inventor: Qingyou Han, West Lafayette, IN (US)

( * ) Notice: Subject to any disclaimer, the term of this patent is extended or adjusted under 35 U.S.C. 154(b) by 246 days.

(21) Appl. No.: 16/926,714

(22) Filed: Jul. 12, 2020

(65) Prior Publication Data

US 2022/0008983 A1 Jan. 13, 2022

(51) Int. Cl.

| | |
|---|---|
| ***B22C 9/06*** | (2006.01) |
| ***B22D 17/20*** | (2006.01) |
| ***B22D 19/00*** | (2006.01) |
| ***C23C 2/12*** | (2006.01) |
| ***C23C 2/32*** | (2006.01) |
| ***B22D 17/22*** | (2006.01) |

(52) U.S. Cl.

CPC ..... *B22C 9/061* (2013.01); *B22D 17/2209* (2013.01); *C23C 2/12* (2013.01); *C23C 2/32* (2013.01); *B22C 9/06* (2013.01)

(58) Field of Classification Search

CPC ..... B22C 9/06; B22C 9/061; B22D 17/2023; B22D 19/00; B22D 19/0081; C23C 2/12; C23C 2/32

USPC ..... 164/14, 33, 72, 138, 75, 100

See application file for complete search history.

(56) References Cited

U.S. PATENT DOCUMENTS

| | | | | |
|---|---|---|---|---|
| 5,611,477 A * | 3/1997 | Wang | B23K 20/08 29/421.2 |
| 6,470,550 B1 * | 10/2002 | Kowalczyk et al. | B22D 19/10 228/122.1 |
| 2022/0072605 A1 * | 3/2022 | Han | C23C 28/02 |

* cited by examiner

*Primary Examiner* — Kevin P Kerns

(57) ABSTRACT

A process of forming an erosion, oxidation, and wear resistant shot chamber, either a gooseneck or a shot sleeve, is provided. The process utilizes a self-healing erosive wear resistant coating on a liner of refractory metal to serve as the working surfaces of a shot chamber. Such a shot chamber is expected to have an improved service life for die casting of corrosive metals and alloys, including hot chamber die casting of aluminum alloys. An improved hot dipping process using stirring in the molten metal bath is also disclosed.

11 Claims, 8 Drawing Sheets

PROCESS FOR MAKING AN EROSION AND WEAR RESISTANT SHOT CHAMBER FOR DIE CASTING APPLICATION

GRANT STATEMENT

None

FIELD OF THE INVENTION

The present invention relates to die casting, more specifically, to an erosion and wear resistant gooseneck and shot chamber for die casting of aluminum alloys.

BACKGROUND OF THE INVENTION

Die casting, also termed as high pressure die casting (HPDC), is a widely-used process that entails the injection of a molten metal into a die cavity under high pressure. The metal, commonly aluminum, magnesium, zinc, their alloys, and sometimes copper, titanium, and their alloys, is transported into a chamber containing a cylindrical channel connected to the die cavity, and then is injected with a piston from the chamber to the die cavity, where it solidifies and forms a solid component. Die casting is generally considered to be a cost-effective process capable of producing precision (net-shape) products at high production rates. Currently, die casting processes are used to produce over 70% of the annual tonnage of all aluminum castings in the United States.

There are two kinds of die casting processes: hot-chamber and cold-chamber die casting. An exemplary hot-chamber die casting process is illustrated in FIG. 1. The hot-chamber die casting process uses a "gooseneck" as the chamber containing a cylindrical channel connected to the die cavity. Part of the gooseneck is submerged into the molten metal in a pot or a holding furnace so that the chamber is hot. A reciprocating plunger in the cylindrical channel draws the molten metal in and injects it into the mold cavity through a nozzle. The injection system for hot-chamber die casting consists of a gooseneck, plunger, and a nozzle.

The cold-chamber process, shown in FIG. 2, involves pouring hot metal into a cold shot chamber or shot sleeve containing a cylindrical channel and injecting it using a ram or a plunger into the die cavity. The injection system for cold-chamber die casting consists of a plunger or ram, and a shot sleeve.

The internal surface of the chamber, either a gooseneck or a shot sleeve, is impacted by the corrosive hot metal as it is drawn in or poured in at relatively high speed. The plunger slides against the internal surfaces of the chamber at high temperatures as well. Consequently, the chamber at its internal surface suffers severe erosion by the corrosive molten metal and wear by the plunger. The chamber material, providing the internal surfaces of the chamber, has to withstand both erosion and wear. The internal surface is the working surface for such a chamber.

The present invention relates to minimizing erosion and wear of the shot chamber, and more broadly, for die tooling, including but not limited to the gooseneck, nozzle, shot sleeve, plunger, ladle, and inserts in die or mold including pins for forming holes in a casting. Die tooling components all have working surfaces in contact with the corrosive molten metal flowing over them at fairly high speeds.

Traditionally, die tooling is made of hot work steels. H13 steel is used widely in the United States. Shot sleeve is made of H13. A gooseneck is made of either cast iron or cast steel.

These die tooling components are expensive to make. The service life of die tooling is vital to the competitiveness of the industry.

Erosion of the gooseneck in molten aluminum is so severe that hot chamber die casting process is not commercially used for making aluminum castings. Attempts have been made to use refractory ceramic materials for making the gooseneck. For example, U.S. Pat. No. 3,067,146 to Gottfried, U.S. Pat. No. 3,652,072 to Lewis, European Patent No. 0827793 to Mild et al, and Taiwan Patent Document No. 201529204 to Eguchi et al. disclose using ceramic goosenecks for aluminum die casting. However, hot-chamber aluminum die casting systems that utilize ceramic liners for the gooseneck or use ceramic materials for the entirety of the gooseneck have not found wide applications because of high financial costs and poor service life of the ceramic components. Ceramic materials conventionally used for such purposes have had issues with thermal fatigue. Also the relatively low tensile properties and brittleness of ceramic materials have resulted in goosenecks prone to damage during die casting operation. U.S. patent application Ser. No. 15/463,345 by Han et al. discloses the use of refractory metals for the liner in a gooseneck. No protection of the liner is discussed and no relationship between the liner and the bulk materials of the gooseneck is defined. A thin refractory metal liner without proper protection cannot survive long in an aggressive oxidation, erosion, and wear environment.

Refractory metals have high melting points and excellent thermal fatigue resistance. They are resistant to erosion [1-2] by molten aluminum but are vulnerable to rapid oxidation at elevated temperatures. At temperatures as low as 500° C., oxidation is significant. By 1100° C., the low oxidation resistance of refractory metals can preclude completely their use in air [3]. Also, the hardness of the refractory metals is much lower than H13 steel. Alloying of the refractory metals improves their hardness to some extent but minimally increases their corrosion resistance [4]. Liners used in the gooseneck have to be not only erosion resistant but also oxidation and wear resistant.

Erosion of steels in molten aluminum is also a severe issue in cold-chamber die casting [1, 5-7] where H13 steel is usually used for the shot chamber or shot sleeve. This is especially true for cold-chamber die casting of structural aluminum alloys because these alloys contain low iron content. U.S. Pat. No. 9,114,455 to Donahue et al discloses an improved shot sleeve cold-chamber for die casting of low-iron aluminum silicon alloys and a method for making the shot sleeve. The shot sleeve includes an erosion resistant liner that tightly fits with the bulk H13 steel within a small tolerance. The liner is selected from refractory metals including titanium, tungsten, molybdenum, ruthenium, tantalum, niobium etc. The shot sleeve made using this invention lasts longer than that of H13 but there are still a number of issues. The liners only tightly fit with the bulk steel in which there is no bond between them. Consequently, thermal distortion is an issue. Thick liners have to be used in order to reduce thermal distortion but the refractory metals are expensive. Oxidation of the refractory metal liner is another issue. Metal loss on the internal surface of the liner opposite to the pour hole is observed. Such metal loss leads to dimension change as well. Furthermore, the low hardness of the refractory metal results in wear and scoring on the internal surface of the liner. Donahue et al [8] report on the initial testing of niobium liners inserted into steel sleeves. Niobium is one metal that does not appear to dissolve in liquid aluminum [9-10] and should therefore better resist erosion and soldering. A casting trial indicated that the plunger tip experienced a higher level of wear which could be related to distortion of the liner and a loose clearance between the plunger tip and the sleeve liner [8-9].

Therefore, there is a need for developing an erosion, oxidation, and wear resistant die casting tooling, including gooseneck for hot-chamber die casting and shot sleeve for cold-chamber die casting applications. Erosion resistant liners are helpful in extending the service life of these die casting tooling. However, the liner surface should be oxidation, wear and erosion resistant. Furthermore, the liner has to be strongly bonded to the bulk material of the die casting tooling in order to avoid tooling distortion which causes excessive wear of the plunger tip and related operational issues.

SUMMARY OF THE INVENTION

In an exemplary embodiment of the present invention, a process of forming an erosion, oxidation, and wear resistant shot chamber, either a gooseneck or a shot sleeve, is provided. The process includes the steps of preparing a liner made of refractory metallic materials with melting temperatures higher than 1600° C., coating the liner with a self-healing coating which has a metallurgical bond to the liner, placing the coated liner in a mold cavity to use it as a core for forming the working surfaces of the shot chamber, and pouring a ferrous liquid alloy into the mold cavity to bond the coated liner with a metallurgical bond and to form a solid composite shot chamber after the liquid alloy is solidified on the coated liner. Such a shot chamber produced using the present invention is expected to have a long service life and a minimal thermal distortion during its service for making die castings.

In another embodiment of the present invention, a process of forming an erosion, oxidation, and wear resistant shot chamber is provided wherein the liner material is a refractory metal or its alloys, including niobium, molybdenum, rhenium, tantalum, titanium, or tungsten, and their alloys. The liner is coated with a protective coating which consists of a metal, an alloy, a bonding agent such a solder, or compounds deposited on the liner using physical vapor deposition (PVD), chemical vapor deposition (CVD), hot dipping, thermal spray, or other surface deposition techniques.

In another embodiment of the present invention, a process of forming an erosion, oxidation, and wear resistant shot chamber is provided wherein the surface layer of the liner is a self-healing coating consisting of compounds which can be formed between the liner materials and the molten alloys being processed in the shot chamber. One of such self-healing coatings is an aluminide coating for die casting of aluminum alloys. Damaged coating can be repaired in-situ by the chemical reaction between the liner materials and the molten aluminum alloy being processed in the shot chamber.

In yet another embodiment of the present invention, a process of enhancing metalization using hot dipping is provided. The process includes preparing a refractory metal liner in the form of a tube coated with a layer of oxidation resistant coating, coating the outer surface of the coated refractory metal tube with a solder material, preparing a ferrous alloy shot chamber and heating it up to desired temperatures, and shrink fitting the shot chamber on the liner tube while the heat of the shot chamber melts the solder material and bonds the shot chamber with the liner tube. Such a shot chamber contains a surface protected refractory liner bonded to the bulk material of the shot chamber which is beneficial in minimizing thermal distortion of the refractory liner during its service for making die castings.

In yet another embodiment of the present invention, a process of enhancing metallization using hot dipping is provided. The process includes the steps of preparing a metallic bath at a temperature of at least 20° C. higher than the liquidus of the material, submerging the solid article in a molten metallic bath, stirring the molten metallic bath to enhance the chemical reaction between the material of the solid article and the molten metallic material at their interfaces, and removing the solid article out of the metallic bath after a layer of intermetallic phases have been formed on the solid article. Such a process can be used for rapid metallization of the refractory liner surfaces, such as aluminizing, at lower hot dipping temperatures and reduced dip duration.

DETAILED DESCRIPTION OF THE INVENTION

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

The invention teaches that the latest methods disclosed in the prior art for the fabrication of die casting tooling using refractory metals have issues with the service life of the tooling. These issues prevent the use of refractory metals from making die tooling. Some of the issues related to the die tooling can be overcome by using protective compounds that are strongly bonded to the surface of refractory metal liner with a metallurgical bond. The liner also needs to be strongly bonded to the bulk material of the die tooling with a metallurgical bond.

Figure 3:
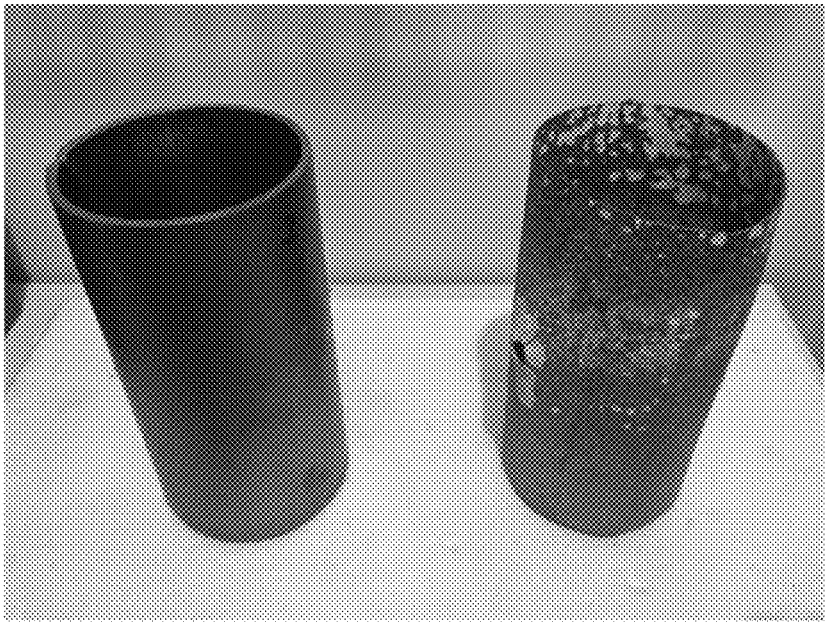
FIG. 3 Prior Art
FIG. 3 shows photographs of Nb-1% Zr tubes suffering from mass loss in an oxidation environment.
Figure 4A:
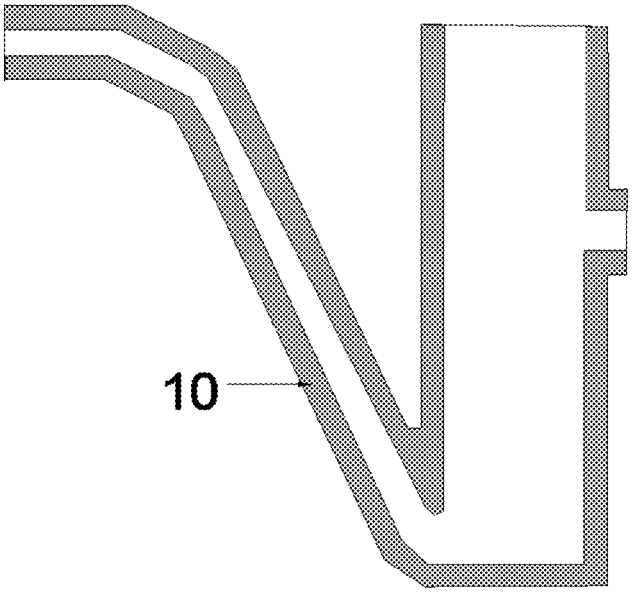
FIGS. 4A, 4B, 4C, 4D, and 4E are schematic views of a layout of one embodiment of the present invention.
Figure 4B:
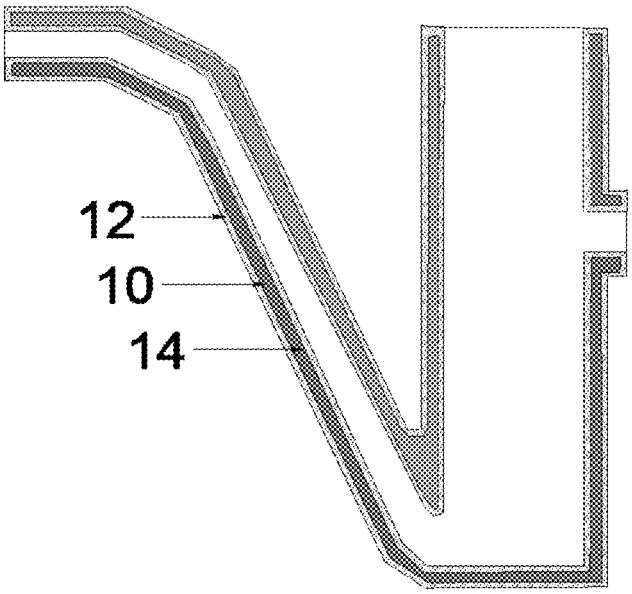
Figure 4C:
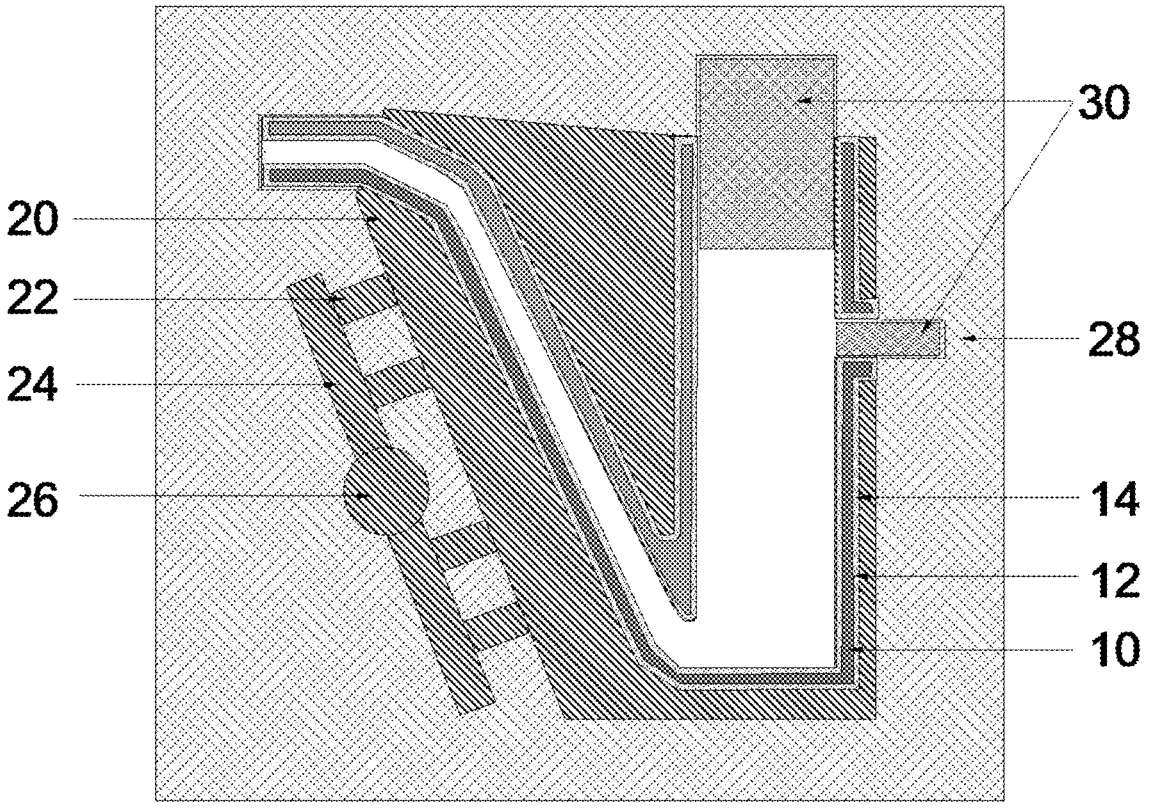
Figure 4D:
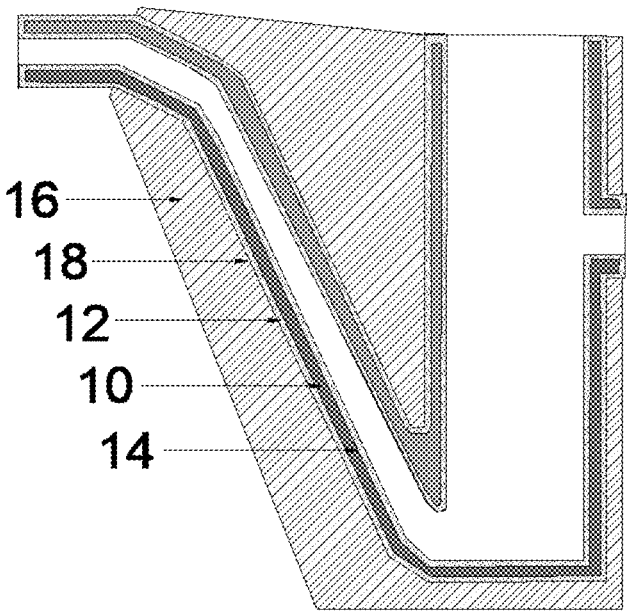
Figure 4E:
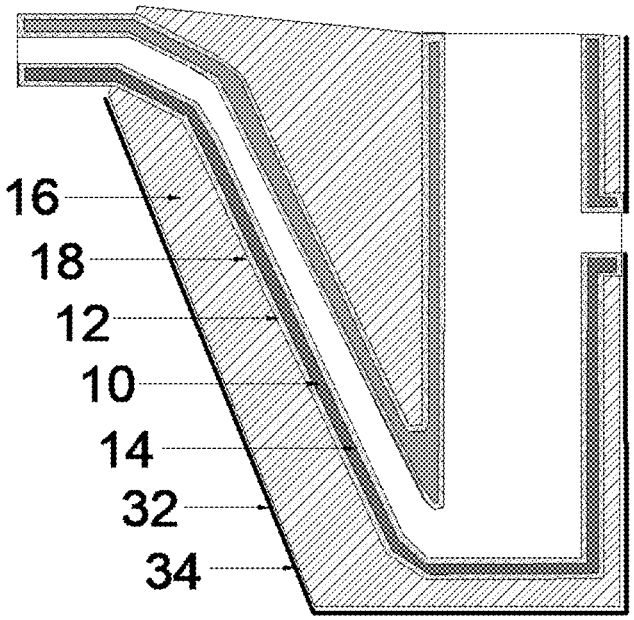
Figure 5A:
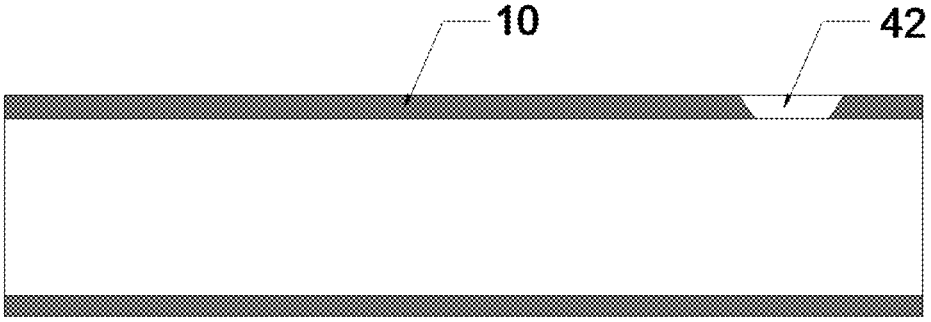
FIGS. 5A, 5B, 5C, and 5D are schematic views of a layout of one embodiment of the present invention.
Figure 5B:
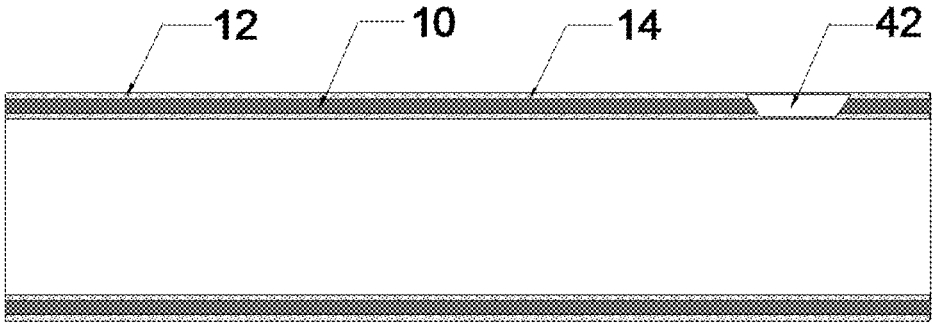
Figure 5C:
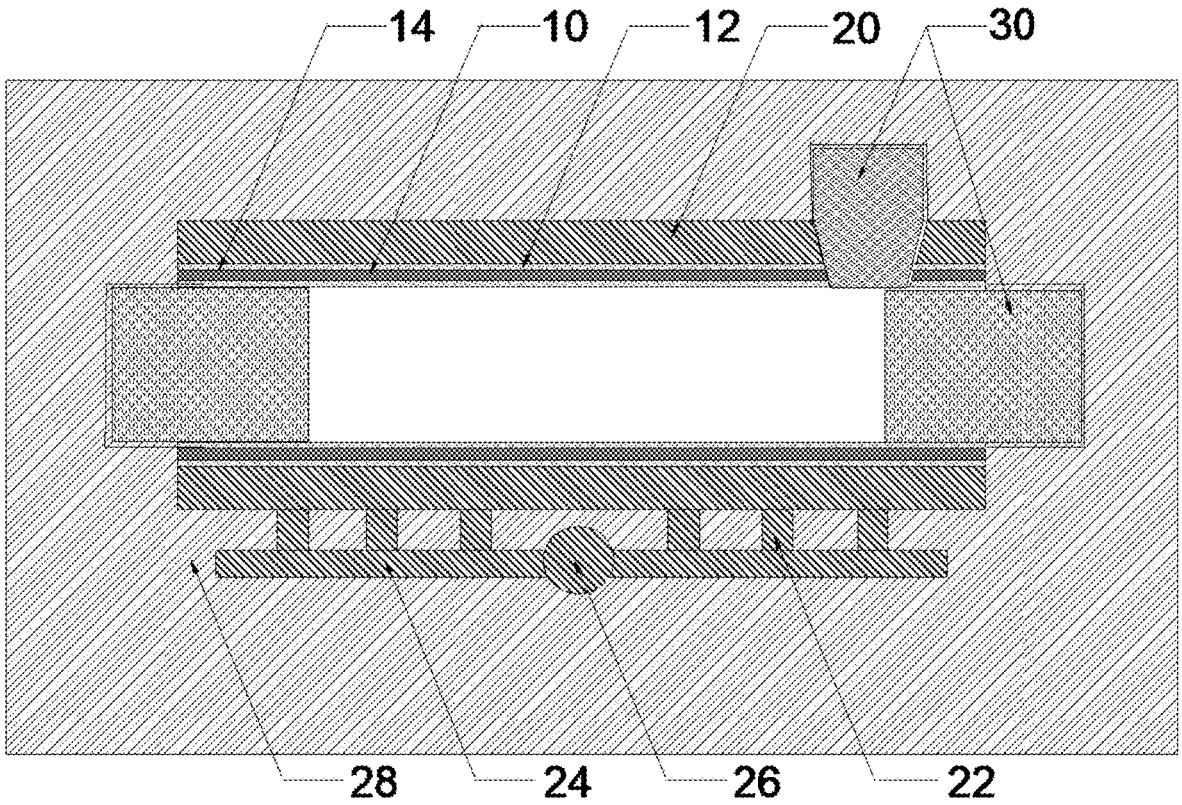
Figure 5D:
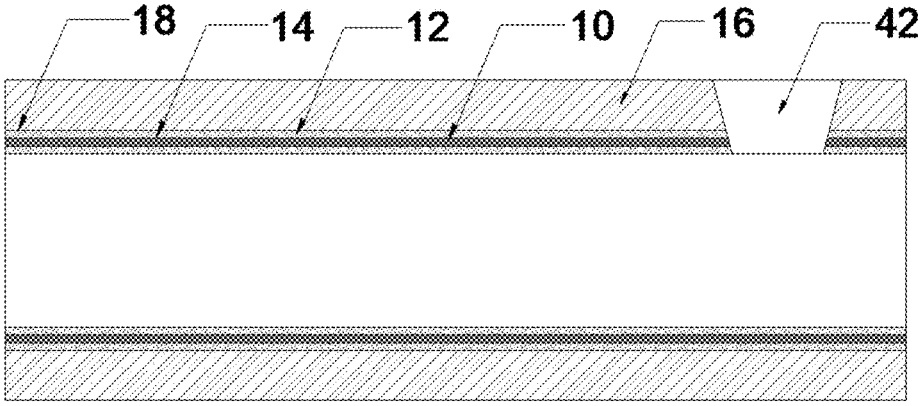

Refractory metals usually have a poor oxidation resistance [3-4]. FIG. 3 illustrates niobium tubes used for melting aluminum alloys in the temperature range of 650 to 750° C. The left side tube is a new one and the right side one is the used one. A significant amount of niobium metal is lost due to the formation of niobium oxide scales which spall off the tube as the oxides have much smaller thermal coefficients than the metal. Two niobium lined shot sleeves were made according to U.S. Pat. No. 9,114,455 to Donahue et al. One shot sleeve was used for over 6,000 cycles which last longer than H13 shot sleeves, but a dent was formed on the inside surface of the shot sleeve opposite to the pour hole where the molten metal impinged the shot sleeve surface. Erosion did not appear to happen at this area, so the mass loss was most likely due to oxidation.

In a preferred embodiment, the present invention relates to a method for forming an erosion, oxidation, and wear resistant shot chamber for die casting applications. The erosion and wear resistance of the shot chamber are provided by a self-healing coating on the surfaces of a refractory metallic alloy liner. The term "self-healing coating" refers to a coating that, if damaged, can be repaired in-situ by chemical reactions between the liner materials and the molten alloy processed in the chamber, forming similar or dissimilar compounds to that of the original coating on the damaged sites. The purpose of using an initial coating on the refractory metal liner is to protect the liner from oxidation during its fabrication process before the liner is in contact with liquid metal. The initial coating can be damaged by the molten metal in the chamber with the liner. However, as long as the damaged site can be filled or replaced immediately by newly formed materials due to the chemical reaction between the molten metal and the materials on the surface of the liner, a protective layer of coating is formed on the surface of the liner. By such a definition of the self-healing coating, coatings that are suitable for protecting refractory metals from oxidation may be used as the initial coating on the refractory liner. These coatings include but are not limited to silicide and nitride coating, hot dipping and plating of various metals and alloys such as aluminum alloy, tin, silver, and zinc alloy, laser printing of metals and alloys, arc surface alloying, spray forming of metals and alloys, PDV and CVD of compounds.

For a liner made of niobium, tungsten, molybdenum, titanium, and their alloys, aluminizing coating is one of the preferred surface coatings. This is because aluminizing produces a metallurgical bond between the refractory metal liner and aluminides. The bond consists of line compounds at the interface between a refractory metal and molten aluminum. These line compounds have high melting temperatures and thus are resistant to erosion and soldering by molten aluminum [5]. As a line compound, its composition falls within a very narrow range as diffusion of elements across this compound becomes difficult because composition difference is the driving force for elemental diffusion and erosion is a diffusion-controlled process. Furthermore, the line compound usually has high hardness which is good in resisting wear in the shot chamber by the plunger. Niobium, for instance, reacts with molten aluminum and forms a line compound, $NbAl_3$. The melting temperature of this compound is 1760° C., much higher than the melting temperature of aluminum (660° C.). Aluminum at the external surface of the compound is resistant to oxidation at elevated temperatures. This line compound, if damaged on the liner surface, can be replaced in-situ with newly formed line compounds in the next cycle of die casting when the liner is in contact with molten metal. Aluminum metal can be deposited on niobium alloys (or molybdenum and its alloys) using hot dipping, chemical vapor deposition, laser printing, fused salt processes, and physical vapor deposition. Aluminum deposited on the refractory metal can then heat treated to improve the formation of aluminides.

Coating of niobium and niobium alloys with aluminum in prior art requires the solid niobium article being submerged in the molten aluminum held at temperatures above 850° C. for a few hours [10-11]. In another embodiment of the present invention, aluminizing on a metallic article is performed at lower temperatures and shorter durations using stirring. Niobium samples attached to a rotor rotating at a linear speed in the range of about 0.5 m/s to 2.2 m/s are coated with a layer of aluminides within 10 min. in an aluminum bath held at 650° C. Stirring can also be achieved using high-intensity ultrasonic vibration. An Nb-1% Zr alloy bar is coated with a layer of aluminum alloy. Aluminizing is performed by submerging the bar into molten aluminum alloy held at 750° C. High-intensity ultrasonic vibrations at a frequency of 20 kHz and power output of up to 1.5 kW are applied on the bar of ¾" diameter to complete the aluminizing process within a minute.

In another preferred embodiment, the present invention relates to a method for forming an erosion, oxidation, and wear resistant shot chamber for die casting applications. The surface coated liner is placed in a mold cavity as a core, or part of a core, for forming the working surfaces of the shot chamber. Molten steel or cast iron is then poured into the mold cavity, reacts with the surface materials of the liner, cools and solidifies on the liner, and form a composite shot chamber with a metallurgical bond between the ferrous material and surface material of the liner. Thus, in addition to protecting the liner from oxidation in air and erosion in molten metal during die casting, another purpose of using the coating on refractory metal liners is to encourage the chemical reaction between the liner material and the bulk ferrous material. The coating can serve as the material for forming the metallurgical bond with the ferrous material or serve as a sacrificial layer to protect the surface of the liner before the liquid ferrous material contacts the solid liner material. Refractory metals such as niobium can readily react with ferrous material to form metallurgical bond if the surface of the liner is free from oxidation.

Yet in another preferred embodiment, the present invention relates to a method for forming an erosion, oxidation, and wear resistant shot chamber for die casting applications. The liner of a refractory metal is first coated with an oxidation resistant layer. The outside surfaces of the coated liner are then coated with another layer of bonding materials such as solders. The bulk material of a shot chamber is heated to elevated temperatures and shrink fitted on the outside surfaces of the coated liner. The heat from the bulk material melts the bonding materials, forming a metallurgical bond between the liner material and the bulk material of the shot chamber.

For hot-chamber die casting, castings of composite gooseneck consisting of refractory metallic alloy liner, or even ceramic liner, has not been tested in the past. This is partly due to the fact that conventional refractory materials are ceramic materials that are not capable of withstanding the thermal shock of contacting molten ferrous alloys such as steels and cast irons. Refractory metals, such as niobium alloys, experience rapid oxidation at temperatures above 400 to 500° C. By 1100° C., the low oxidation resistance of refractory metals can completely preclude their use in air [3-4]. Therefore, according to conventional wisdom, it is unreasonable to cast liquid iron or steel, usually at temperatures of above 1300° C., on niobium alloys. Furthermore, niobium has been an alloying element added in molten cast iron or steel to improve their mechanical properties, indicating that niobium can readily dissolve into molten ferrous alloys. Such a phenomenon prevents people from attempting to cast a composite gooseneck containing a thin liner of refractory metal. The method of this invention is novel. It discloses the idea of utilizing the reaction of the liner materials with the bulk materials during casting to form a metallurgical bond that strongly joins the liner to the bulk material as a whole one-piece gooseneck.

For cold-chamber die casting, conventional methods for fabricating a shot sleeve with a refractory metal liner involve using a rough chamber of wrought H13 steel, machining to expand a portion of its internal diameter, and inserting the liner tightly into the shot sleeve. The liner has to be thick enough to reduce thermal distortion during its service because the liner is not bonded to the bulk material of the chamber. Refractory metals are expensive, so the use of a thick refractory metal increases the costs of the chamber substantially. A shot sleeve with a niobium liner was built and tested [8-9]. After this shot sleeve was used for around 300 shots or cycles, the liner was pushed towards the dies/molds due to its plastic deformation, leaving a gap at the ram end. Such a gap decreases the service life of the ram. It is also a safety concern. Another issue is the low hardness of the refractory liner which leads to severe wear of the liner during service. Furthermore, premium H13 steel with strict heat treatment procedures has to be used as the bulk material for the chamber. H13 steel is also more expensive than conventional high strength cast steels.

This invention teaches the use of refractory metal liner with a strong metallurgical bond to the bulk material of the shot chamber. The thermal shock of the molten metal during die casting is applied on the refractory metal liner. The bulk material of the chamber, which is buffered by the liner, is not in direct contact with the molten metal and thus experiences much less thermal shock. As a result, the present invention enables the use of low cost steels with higher strength but lower thermal shock resistance than the bulk materials for the shot sleeve. The present invention also teaches the use of a "self-healing" wear resistant coating that has a metallurgical bond to the refractory liner. Such a coating, if damaged, can be repaired in-situ by chemical reactions between the molten metal and the liner. The molten metal is likely to fill the damaged sites on the liner. The filled metal will have enough time to react with the liner materials during the following cycles of die casting operations. The reaction products between the liner material and the molten metal are intermetrallics. These intermetallic phases are hard enough to resist wear by the plunger and erosion by the molten metal.

Figure 1:
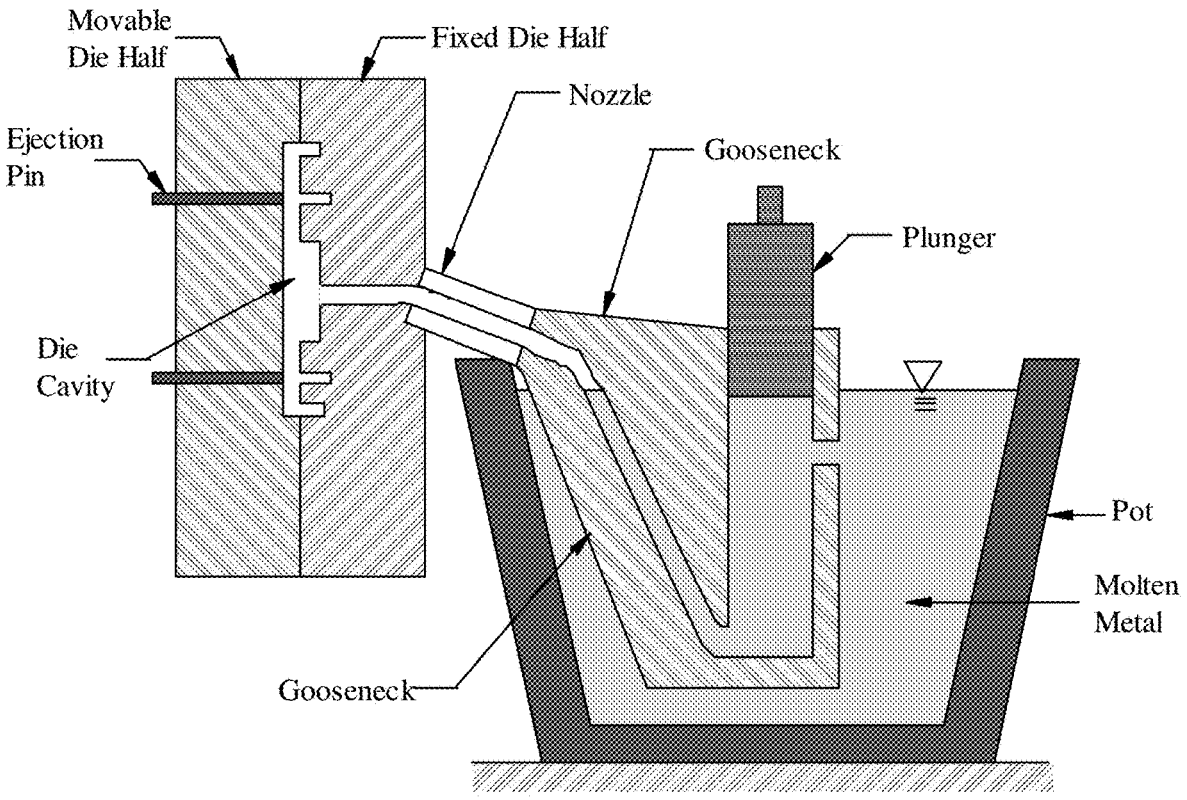
FIG. 1 Prior Art
FIG. 1 schematically represents a hot-chamber die casting process and die tooling associated with the process.

FIG. 4 schematically illustrates a preferred method for forming an erosion, oxidation, and wear resistant shot chamber or gooseneck shown in FIG. 1 for the hot-chamber die casting process. A thin liner of refractory metallic alloy 10 is prepared (FIG. 4A) and coated with an oxidation resistant coating 12 (FIG. 4B). The coating 12 is selected such that a metallurgical bond is formed at the interface 14 between the liner 10 and the coating material 12. The coated liner is then placed in the cavity of mold 28. Cores 30 are used to support the liner 10 in the mold 28, shown in FIG. 4C. A molten ferrous alloy 20 is then poured on the coated liner 10 through downsprue 26, runner 24, and gates 22 to fill the remaining portion of the mold cavity, forming the bulk part of the gooseneck after the molten ferrous alloy is solidified on the liner 10. By removing the gating system consisting of the downsprue 26, runner 24, and gates 22, a solid composite gooseneck is made, shown in FIG. 4D. The composite gooseneck made using this invention has a metallurgical bond at the interface 18 between the bulk ferrous alloy 16 and the coated liner 10 & 12, and at the interface 14 between the refractory metal liner 10 and the coating material 12. Finally, another coating 32 is applied on the external surface 34 of the ferrous alloy 16 to protect the ferrous alloy 16 from erosion in molten metal, shown in FIG. 4E. The coating 32 can be any coating conventionally used in the permanent mold casting process for protecting the permanent molds. The coating 32 can also be any coating that is conventionally used in the die casting industry for protecting dies, inserts, and pins. The coating 32 can also be refractory metal coating or just simply a layer of refractory sheet metal bonded to the outside surface of the gooseneck contacting the molten metal.

Figure 2:
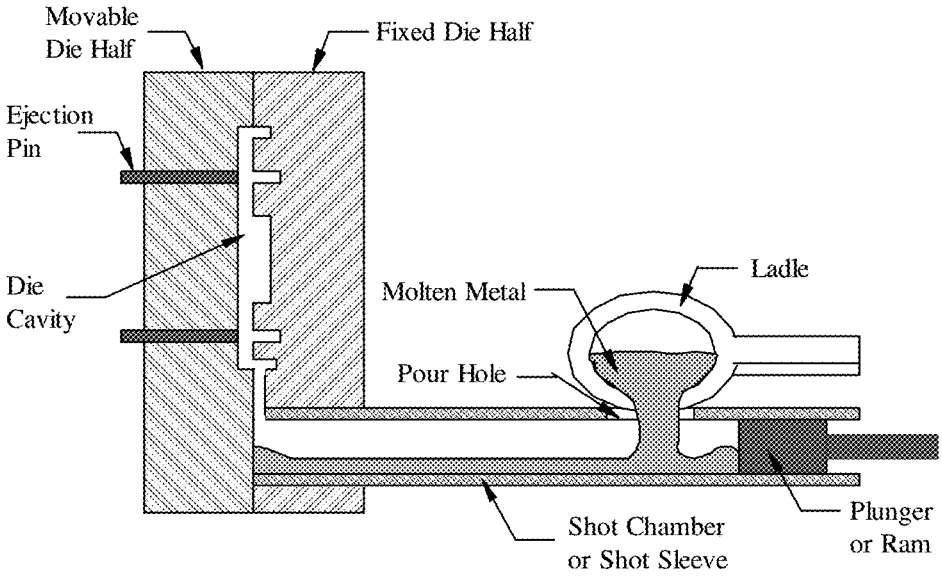
FIG. 2 Prior Art
FIG. 2 schematically represents a cold-chamber die casting process and die tooling associated with the process.

FIG. 5 schematically illustrates a preferred method for forming an erosion, oxidation, and wear resistant shot chamber or shot sleeve shown in FIG. 2 for the cold-chamber die casting process. A thin liner of a refractory metallic alloy 10 with a pour hole 42 is prepared (FIG. 5A) and coated with an oxidation resistant coating 12 (FIG. 5B). The coating 12 is selected and applied such that a metallurgical bond is formed at the interface 14 between the liner 10 and the coating material 12. The coated liner is then placed in the cavity of mold 28, shown in FIG. 5C. Cores 30 are used to support the coated liner 10 in the mold 28. A molten ferrous alloy 20 is then poured on the coated liner 10 through the downsprue 26, runner 24, and gates 22 to fill the remaining portion of the mold cavity, forming the bulk part of the shot chamber after the molten ferrous alloy is solidified on the liner 10. By removing the gating system consisting of the downsprue 26, runner 24, and gates 22, a solid composite shot chamber is made, shown in FIG. 5D. The composite shot sleeve made using the present invention has a metallurgical bond at the interface 18 between the bulk ferrous alloy 16 and the coated liner 10 & 12, and at the interface 14 between the refractory metal liner 10 and the coating material 12. Because the liner 10 is strongly bonded to the bulk ferrous alloy 16 and the liner 10 will be in contact with the high temperature molten metal, the bulk ferrous alloy 16 will be working at much lower temperatures and with much smaller thermal shock. As a result, a large number of high strength steels or cast irons can be selected for replacing premium H13 steel for building a shot sleeve.

Figure 6:
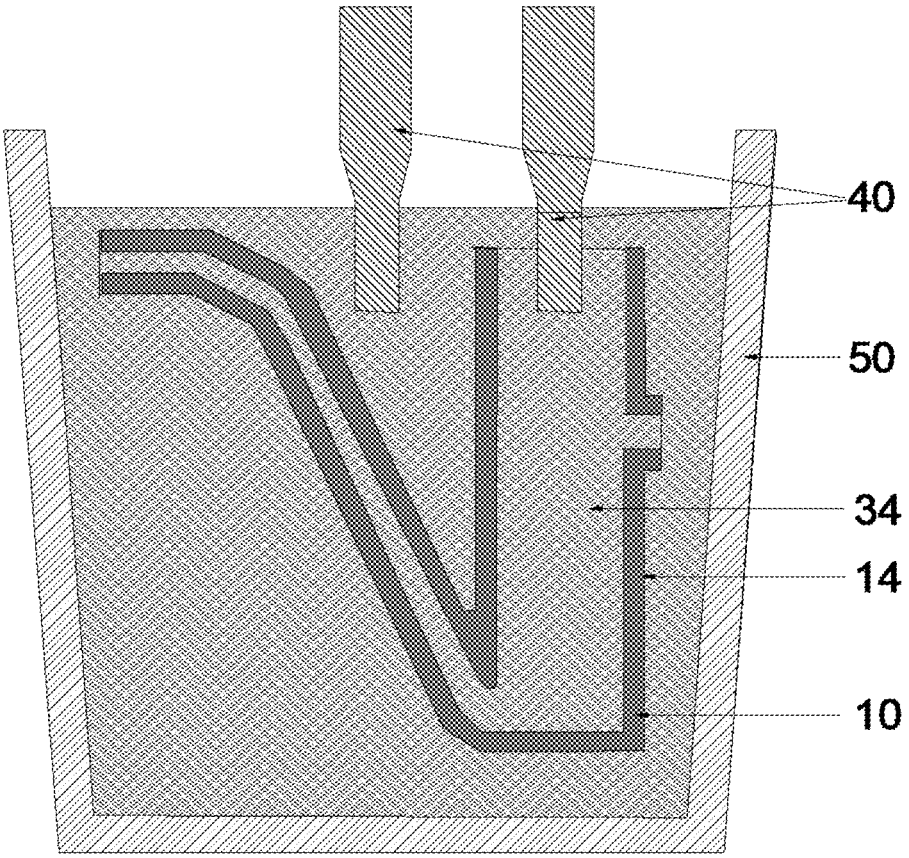
FIG. 6 is a schematic view of a layout of one embodiment of the present invention.

FIG. 6 schematically illustrates an improved method of coating metals and their alloys on the refractory metal liner. Molten alloy is prepared in a furnace 50. A refractory metal liner 10 is then submerged into the melt 34. High-intensity ultrasonic vibration is applied into the molten metal 34 using ultrasonic radiators 40. After a layer of intermetallic compounds is formed on the surfaces of the liner 10, the coated liner can be removed from the melt 34 and used for making a composite shot chamber using the approaches shown above. Metals and their alloys that can be coated on a refractory metal liner include but not limited to aluminum, zinc, silver, tin, and metallic solders.

While the invention has been described in connection with specific embodiments thereof, it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

REFERENCES

1. J. Song, T. DenOuden, and Q. Han, "Soldering Analysis of Core Pins", *NADCA Transactions* 2011, T11-062.
2. Z. Liu, Q. Han, and J. Li, "Ultrasound Assisted in situ Technique for the Synthesis of Particulate Reinforced Aluminum Matrix Composites," *Composites Part B: Engineering*, vol. 42, 2011, pp. 2080-2084.
3. C. L. Briant, "The properties and Uses of Refractory Metals and Their Alloys," *High Temperature Silicides and Refractory Alloys*, C. L. Briant et al eds., Materials Research Society Symposium Proceedings, vol. 322, 1994, pp. 305-314.

4. J. B. Lambert, "Refractory Metals and Alloys," ASM Handbook, vol. 2, 1990, pp. 557-565.
5. Q. Han, and S. Viswanathan, "Analysis of the Mechanism of Die Soldering in Aluminum Die Casting", *Metallurgical and Materials Transaction A*, vol. 34A, (2003), pp. 139-146.
6. Y. Chu, P. Cheng, and R. Shivpuri "A Study of Erosive Wear in Die Casting Dies: Surface Treatments and Coatings," *NADCA Transactions* 1993, pp. 361-371.
7. Q. Han, "Mechanism of Die Soldering during Aluminum Die Casting," *China Foundry*, vol. 12 (2), (2015), pp. 136-143.
8. R. Donahue, S. Knickel, P. Schneider, M. Witzel, J. Melius, and A. Monroe, "Performance of Shot Sleeve with Different Refractory Metal Liners in Casting of Structural Aluminum Die Casting Alloy 362", *NADCA Transactions* 2014, T14-011.
9. R. Donahue, "Avoiding Washout in Shot Sleeve When Used with Low Iron, Structural Aluminum Die Casting Alloys", *NADCA Transactions* 2013, T13-051. A. B. William, and S. Midson, Shot System Components User's Guide, NADCA Publication: 525, NADCA 2016.
10. G. Slama, and A. Vignes, "Coating of Niobium and Niobium Alloys with Aluminum. Part I. Pack-Cementation Coating," *Journal of the Less Common Metals*, vol. 23, No. 4, 1971, pp. 375-393.
11. G. Slama, and A. Vignes, "Coating of Niobium and Niobium Alloys with Aluminum. Part II. Hot-Dipped Coating," Journal of the Less Common Metals, vol. 24, No. 1, 1971, pp. 1-21.

What is claimed is:

1. A method for forming an erosion, oxidation, and wear resistant composite die casting shot chamber, the method comprising the steps of:

preparing a liner made of refractory metallic materials with melting temperatures higher than 1600° C.;

coating the liner with a self-healing coating which has a metallurgical bond to the liner, wherein the coating is also capable of promoting formation of a metallurgical bond between ferrous alloy and the liner in a casting process;

placing the coated liner in a mold cavity and using it as a core for forming working surfaces of the shot chamber;

pouring a ferrous liquid alloy into the mold cavity to bond the coated liner with a metallurgical bond and to form a solid composite shot chamber after the liquid alloy is solidified on the coated liner;

machining the solid composite shot chamber to its final dimensions.

2. A method of claim 1, wherein the shot chamber includes gooseneck, shot sleeve, and components that are associated with the shot chamber including plunger, ram, nozzle, and die insert.

3. A method of claim 2, wherein outside surfaces of the ferrous alloy of the gooseneck that are in contact with a molten metal during a die casting process are covered by a coating that is resistant to erosion in the molten metal.

4. A method of claim 1, wherein the refractory metallic material is niobium, molybdenum, rhenium, tantalum, titanium, tungsten, or alloys thereof.

5. A method of claim 1, wherein said coating on the liner is an aluminizing coating using hot plating, cementation-packing, laser-printing, thermal spring, arc surface alloying, or other techniques.

6. A method of claim 1, wherein said coating on the liner is a silicide coating.

7. A method of claim, 1 wherein said coating on the liner is a zinc coating.

8. A method of claim 1, wherein said coating on the liner is an oxidation resistant coating used for protecting a refractory metal from oxidation.

9. A method of claim 1, wherein the coating on the liner is a carbide, nitride, silicide, or a titanium aluminum nitride coating that is applied using a physical vapor deposition process or a chemical vapor deposition process.

10. A method of claim 1, wherein said ferrous alloy is cast iron.

11. A method of claim 1, wherein said ferrous alloy is steel.

* * * * *